US008494173B2

(12) United States Patent
Jensen et al.

(10) Patent No.: US 8,494,173 B2
(45) Date of Patent: Jul. 23, 2013

(54) INTEGRATED CIRCUIT WITH CONFIGURABLE OUTPUT CELL

(75) Inventors: Dan Christian Raun Jensen, Hellerup (DK); Palle Hegne Pedersen, Slagelse (DK)

(73) Assignee: GN ReSound A/S, Ballerup (DK)

( * ) Notice: Subject to any disclaimer, the term of this patent is extended or adjusted under 35 U.S.C. 154(b) by 0 days.

(21) Appl. No.: 13/304,991

(22) Filed: Nov. 28, 2011

(65) Prior Publication Data

US 2013/0108088 A1 May 2, 2013

(30) Foreign Application Priority Data

Oct. 28, 2011 (DK) ..... 2011 00832
Oct. 28, 2011 (EP) ..... 11187140

(51) Int. Cl.
*H04R 3/00* (2006.01)
*H04R 25/00* (2006.01)

(52) U.S. Cl.
USPC ..... 381/60; 381/111; 381/113; 381/122; 381/312; 381/323

(58) Field of Classification Search
None
See application file for complete search history.

(56) References Cited

U.S. PATENT DOCUMENTS 4,795,917 A 1/1989 Scott et al.
5,973,552 A 10/1999 Allan
6,087,852 A 7/2000 Briggs et al.
6,088,339 A * 7/2000 Meyer ..... 370/296
6,252,422 B1 6/2001 Patel et al.
6,346,846 B1 2/2002 Bertin et al.
6,630,724 B1 10/2003 Marr
2002/0071582 A1 * 6/2002 Troelsen et al. ..... 381/314
2010/0260367 A1 10/2010 Hasler et al.
2011/0211717 A1 * 9/2011 Hoevesteen ..... 381/323

FOREIGN PATENT DOCUMENTS

EP 1 945 001 A2 7/2008

OTHER PUBLICATIONS

1st Technical Examination and Search Report dated Jun. 22, 2012 for Danish Application No. PA 2011 00832.
Search Report dated Mar. 14, 2012 for EP Application No. 11187140.6.

* cited by examiner

*Primary Examiner* — Guerrier Merant
(74) *Attorney, Agent, or Firm* — Vista IP Law Group, LLP

(57) ABSTRACT

An integrated circuit includes at least one output cell including a first output cell having a ground pin connected to a ground rail, a first power supply pin connected to a first power rail, a second power supply pin connected to a second power rail, a data pin, at least one voltage select pin, and an output pin wired to the first output pad. The first output cell is configured to operate according to a first mode wherein the output pin has a first voltage amplitude, and according to a second mode wherein the output pin has a second voltage amplitude larger than the first voltage amplitude depending on a control signal applied to the at least one voltage select pin.

14 Claims, 2 Drawing Sheets

INTEGRATED CIRCUIT WITH CONFIGURABLE OUTPUT CELL

RELATED APPLICATION DATA

This application claims priority to, and the benefit of, European patent application No. 11187140.6, filed Oct. 28, 2011, pending, and Danish patent application No. PA201100832, filed on Oct. 28, 2011, pending, the entireties of both of which are expressly incorporated by reference herein.

FIELD

The present application relates to an integrated circuit (IC) with a configurable output cell, in particular to an IC for a hearing device or adapted for a hearing device.

BACKGROUND

Integrated circuits (ICs) or chips with embedded digital signal processors are widely used in the hearing aid industry to provide a compact and small hearing aid. The ICs used in hearing aids are small and the number of Input/Output ports or pads is limited. Typically, ICs are designed to interface specific components of the hearing aid.

SUMMARY

There is a need for increasing the design flexibility when designing and constructing hearing aids to be able to use different components or be able to use the same component in a number of different hearing device models. Further, there is a need for providing ICs with low power consumption due to the limited power supply capacity of a hearing device.

Accordingly, an integrated circuit (IC) for a hearing device is provided, wherein the integrated circuit comprises a ground rail, a first power rail adapted to carry a first voltage, and a second power rail adapted to carry a second voltage, the integrated circuit comprising a number of pads for connecting the integrated circuit to other components, the number of pads including at least one output pad including a first output pad. The integrated circuit comprises at least one output cell including a first output cell having a ground pin connected to the ground rail, a first power supply pin connected to the first power rail, a second power supply pin connected to the second power rail, a data pin, at least one voltage select pin and an output pin wired to the first output pad. The first output cell is adapted to operate according to a first mode wherein the voltage on the first output pin has a first amplitude, and according to a second mode wherein the voltage on the first output pin has a second amplitude larger than the first amplitude depending on a control signal applied to the at least one voltage select pin.

Also disclosed is a method for manufacture of an integrated circuit. The method comprises providing at least one output cell having an output pin and at least two drive transistors each having a first terminal connected to a respective first and a second power supply pin of the output cell, a second terminal, a third terminal connected to the output pin and a fourth terminal, wherein the fourth terminal of the two drive transistors are wired such that the voltage difference between the third and fourth terminal of the respective drive transistors is less than the diode threshold voltage between the third and fourth terminal. The method may comprise wiring the fourth terminals to the power supply pin adapted to carry the largest supply voltage, e.g. the second power supply pin.

It is an advantage that the voltage amplitude of the first output pad may be easily adjusted by adjusting a register setting during configuration or even during use, thereby increasing the design flexibility for hearing aid constructors without increasing the number of pads on the IC, and at the same time maintaining a low power consumption by avoiding undesired current paths in the IC.

In accordance with some embodiments, an integrated circuit for a hearing device includes a ground rail, a first power rail configured to carry a first voltage (V1), a second power rail configured to carry a second voltage (V2), and a number of pads for connecting the integrated circuit to other components, the number of pads including at least one output pad, the at least one output pad having a first output pad. The integrated circuit also includes at least one output cell including a first output cell having a ground pin connected to the ground rail, a first power supply pin connected to the first power rail, a second power supply pin connected to the second power rail, a data pin, at least one voltage select pin, and an output pin wired to the first output pad. The first output cell is configured to operate according to a first mode wherein the output pin has a first voltage amplitude, and according to a second mode wherein the output pin has a second voltage amplitude larger than the first voltage amplitude depending on a control signal applied to the at least one voltage select pin.

In accordance with other embodiments, a method for manufacture of an integrated circuit includes providing at least one output cell having an output pin, a first drive transistor, and a second drive transistor, wherein each of the first and second drive transistors has a first terminal connected to a first power supply pin and a second power supply pin of the output cell, a second terminal, a third terminal connected to the output pin, and a fourth terminal, wherein the fourth terminals of the drive transistors are wired such that a voltage difference between the third and fourth terminals of the first drive transistor is less than a diode threshold voltage between the third and fourth terminals of the first drive transistor.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of the scope of the claims.

DETAILED DESCRIPTION

Figure 1:
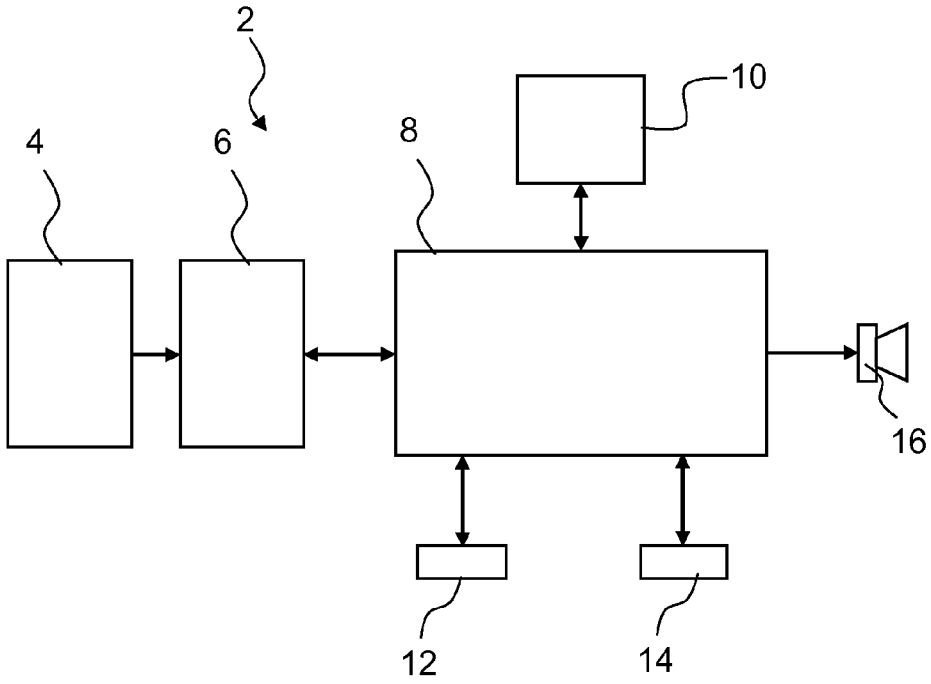
FIG. 1 schematically illustrates a hearing device.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

In accordance with some embodiments, an integrated circuit for a hearing device includes a ground rail, a first power rail configured to carry a first voltage (V1), a second power rail configured to carry a second voltage (V2), and a number of pads for connecting the integrated circuit to other components, the number of pads including at least one output pad, the at least one output pad having a first output pad. The integrated circuit also includes at least one output cell including a first output cell having a ground pin connected to the ground rail, a first power supply pin connected to the first power rail, a second power supply pin connected to the second power rail, a data pin, at least one voltage select pin, and an output pin wired to the first output pad. The first output cell is configured to operate according to a first mode wherein the output pin has a first voltage amplitude, and according to a second mode wherein the output pin has a second voltage amplitude larger than the first voltage amplitude depending on a control signal applied to the at least one voltage select pin.

The at least one output cell, e.g. the first output cell, may be configured to form a part of or be embedded in an input/output (IO) cell if bidirectional communication is desired.

The integrated circuit optionally comprises a processing core e.g. for digital signal processing of digital audio signal in order to compensate for hearing impairment of a user. The processing core is connected to a number of communication cells or peripheral units for communication with other units or components, e.g. an AD converter unit, user interface, memory unit and/or radio unit of a hearing device. Accordingly, the IC comprises at least one communication cell, including at least a first communication cell embedding one or more output cells as described herein. The IC may comprise a second and/or a third communication cell.

A communication cell may be adapted to communicate according to one or more standard protocols. Exemplary protocols may include but are not limited to Serial Peripheral Interface Bus (SPI), Inter-Integrated Circuit (IIC or I2C) with master and/or slave, Integrated Interchip Sound (IIS, I2S), and protocols for wireless communication, etc.

A communication cell or unit may comprise one or more output cells, e.g. a first output cell and/or a second output cell, depending on the functionality of the communication cell. A communication cell may comprise one or more input cells. A communication cell may comprise one or more input/output (IO) cells, i.e. cells that are adapted for bidirectional communication.

The integrated circuit comprises a number of pads for connecting the IC or communication cells of the IC to other components such as memory units, radio units, user interfaces, power supplies such as a battery or others. The number of pads includes a first pad for connection to ground or other reference voltage, a second pad for connection to a power supply, such as a battery, and a number of communication pads including a first communication pad adapted for operating as an output pad for connecting the IC to other components.

The first power rail may be adapted to carry a first voltage $V_1$, such as $V_{battery}$, and the second power rail may be adapted to carry a second voltage $V_2$. The second voltage $V_2$ may be larger than the first voltage $V_1$. In one or more embodiments, $V_2=2*V_{battery}$.

An output cell, e.g. a first output cell and/or a second output cell, may comprise a first transistor, a second transistor and a third transistor, where each transistor has a first terminal, a second terminal, a third terminal, and a fourth terminal.

The first transistor may be an N-MOS transistor where the first terminal is the source, the second terminal is the gate, the third terminal is the drain and the fourth terminal is the body. The first transistor may be configured to pull the voltage on the output pin towards ground or other reference voltage applied to the ground rail. Accordingly, the first transistor may be denoted a ground transistor.

The second, third and/or a fourth transistor may be P-MOS transistors where the first terminal is the source, the second terminal is the gate, the third terminal is the drain and the fourth terminal is the body. The second, third and/or a fourth transistor may be configured to pull or drive the voltage on the output pin towards the voltage applied to the respective power supply pins via power rails available in the IC. Accordingly, the second, third and/or fourth transistors may be denoted drive transistors. The IC may comprise a plurality of drive transistors, each connected between the output pin and a respective power supply pin. The fourth terminal of at least two drive transistors may be connected to a common terminal with a voltage level equal to or larger than the voltage level on the third terminals of the at least two drive transistors.

In one or more output cells, the first terminal of the first transistor may be wired to the ground pin and the third terminal of the first transistor may be wired to the output pin. The fourth terminal of the first transistor may be wired to the first terminal.

The second terminal of the first transistor may be wired to the data pin or connected to the output of a first level shifter adapting a data signal on the data pin to correct signal amplitudes.

In one or more output cells, the first terminal of the second transistor may be wired to the first power supply pin and the third terminal of the second transistor may be wired to the output pin.

In one or more output cells, the first terminal of the third transistor may be wired to the second power supply pin and the third terminal of the third transistor may be wired to the output pin.

In one or more output cells, the fourth terminals of the drive transistors may be wired such that a voltage difference $V_{dif}=V_{third\ terminal}-V_{fourth\ terminal}$ between the third terminals and the fourth terminals of the respective drive transistors is less than the diode threshold voltage $V_{thres}$ for the parasitic diode between the third and fourth terminal. The voltage difference $V_{dif}$ may be less than 0.4 V. For one or more drive transistors, the voltage difference $V_{dif}$ may be less than 0.4 V, such as less than 0.3 V, less than 0.2 V. In one or more embodiments, the voltage difference $V_{dif}$ may be less than or equal to 0V. In an embodiment, where the fourth terminals are wired to the largest power supply voltage, it is ensured that $V_{dif}$ is less than or equal to 0V irrespective of the mode of operation.

In one or more output cells, e.g. the first output cell, the fourth terminal of the second transistor and the fourth terminal of the third transistor may be wired to the power supply pin carrying the largest voltage. The fourth terminal of the second transistor and the fourth terminal of the third transistor may be wired to a common terminal. The first terminal of the third transistor may be the common terminal. Thereby undesired leakage currents may be avoided when the output cells operate in the mode with the smallest voltage amplitude on the output pin.

The second terminals of the second transistor and the third transistor may be connected to the output of a logical circuit of the first output cell for selecting between a first mode (second transistor active) and a second mode (third transistor active) of operation.

One or more output cells of the integrated circuit may thus be adapted to be able to operate in a first mode wherein the voltage signal on the output pin switches between $V_{GND}$* and $V_1$*, and in a second mode wherein the voltage signal on the output pin switches between $V_{GND}$* and $V_2$*, depending on a control signal applied to the at least one voltage select pin.

The integrated circuit may comprise a third power rail adapted to carry a third voltage $V_3$, and the first output cell may comprises a fourth transistor connected between the output pin and a third power supply pin connected to the third power rail.

The fourth transistor has a first terminal, a second terminal, a third terminal and a fourth terminal. The fourth terminal may be wired to the common terminal. The first output cell may be adapted to operate according to a third mode wherein the voltage on the first output pin has a third amplitude depending on a control signal applied to the at least one voltage select pin. The first terminal of the fourth transistor may be wired to the third power supply pin, and the third terminal of the fourth transistor may be wired to the output pin. The second terminal of the fourth transistor may be wired to a logical circuit to enable activation of the fourth transistor in a third mode of operation, wherein the voltage signal on the output pin switches between $V_{GND}$* and $V_3$*, depending on a control signal applied to the at least one voltage select pin.

One or more output cells of the integrated circuit may comprise a logical circuit having input connected to the at least one voltage select pin and the data pin, and output connected to the second terminals of the drive transistors (second, third and fourth transistor if present) for selecting between the modes by selectively activating the second, third and fourth transistor.

The integrated circuit may comprise at least one level shifter including a first level shifter between the data pin and the second terminals of the first, second and third transistor for adapting a data signal to correct signal amplitudes. The first level shifter may be arranged between the data pin and the logical circuit and/or between the logical circuit and the second terminals of the drive transistors.

The at least one level shifter may include a second level shifter between the at least one voltage select pin and the logical circuit for adapting a voltage select signal to correct signal amplitudes for the logical circuit.

The integrated circuit may comprise a core connected to the first output cell, wherein the core is adapted to perform signal processing for a hearing device.

FIG. 1 shows a hearing device 2. The hearing device 2 comprises an audio input interface 4 for receiving audio signal(s) in electronic and/or acoustic form. The audio input interface 4 may comprise one or more microphones, e.g. a first microphone and/or a second microphone, and/or a telecoil. The audio input interface 4 may comprise an audio connector or audio input boot for coupling external audio-sources to the hearing device 2. The audio input interface 4 is connected to an AD converter unit 6 which is connected to a signal processing unit or integrated circuit 8. The AD converter unit 6 converts or transforms audio signals from the audio input interface 4 and send the digital audio signal(s) to the signal processing unit 8 for processing, e.g. in order to compensate for hearing loss or other hearing impairment. The signal processing unit 8 may send control signals to the AD converter unit 6 to configure and control operation of the AD converter unit 6. The signal processing unit 8 may be connected to a user interface 10 in order to allow a user, a computer or another hearing device to communicate with the hearing device, e.g. during configuration and/or during use of the hearing aid. The user interface 10 may comprise a push button and/or a connector for a data cable in order to couple the hearing device to e.g. a computer during configuration or another hearing device. The hearing device 2 may comprise a memory unit 12 connected to the signal processing unit 8 for storing data or hearing aid parameters, and the hearing device 2 may optionally comprise a radio unit 14 connected to the signal processing unit 8 and adapted for receiving and/or transmitting radio signals, e.g. in order to enable the hearing device 2 to communicate wirelessly with another device, such as a hearing device and/or a wireless interface. The AD converter unit 6 may be embedded in the signal processing unit or integrated circuit 8. The hearing device 2 may comprise a receiver or loudspeaker 16 connected to the signal processing unit 8 for emitting audio signals to a user.

Figure 2:
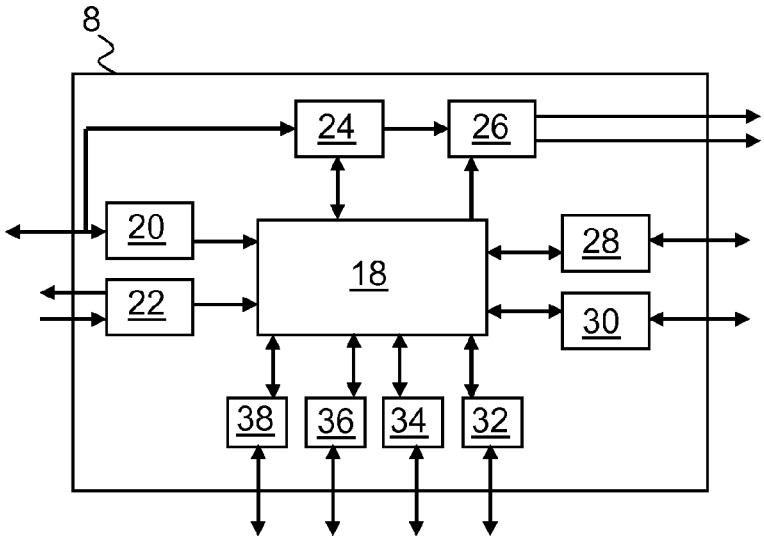
FIG. 2 schematically illustrates an exemplary integrated circuit.

FIG. 2 shows an exemplary signal processing unit or integrated circuit 8 according to some embodiments. The integrated circuit 8 comprises a processing core 18 e.g. for digital signal processing of digital audio signals from an AD converter 6. The processing core 18 is connected to a number of communication cells or peripheral units for communication with other units of the hearing device, e.g. the AD converter unit 6, user interface 10, memory unit 12 and/or radio unit 14.

The integrated circuit 8 comprises a number of communication cells 20, 28, 30, 32, 34, 36, 38 forming interfaces to the processing core 18. A communication cell may be configured to implement different communication protocols depending on the unit to be connected thereto. A first and/or second output cell or IO cell may be implemented in each or one or more of the communication cells 20, 28, 30, 32, 34, 36, 38. Further, the integrated circuit may comprise a clock management cell 22 optionally comprising one or more output cells or IO cells as described herein.

Figure 3:
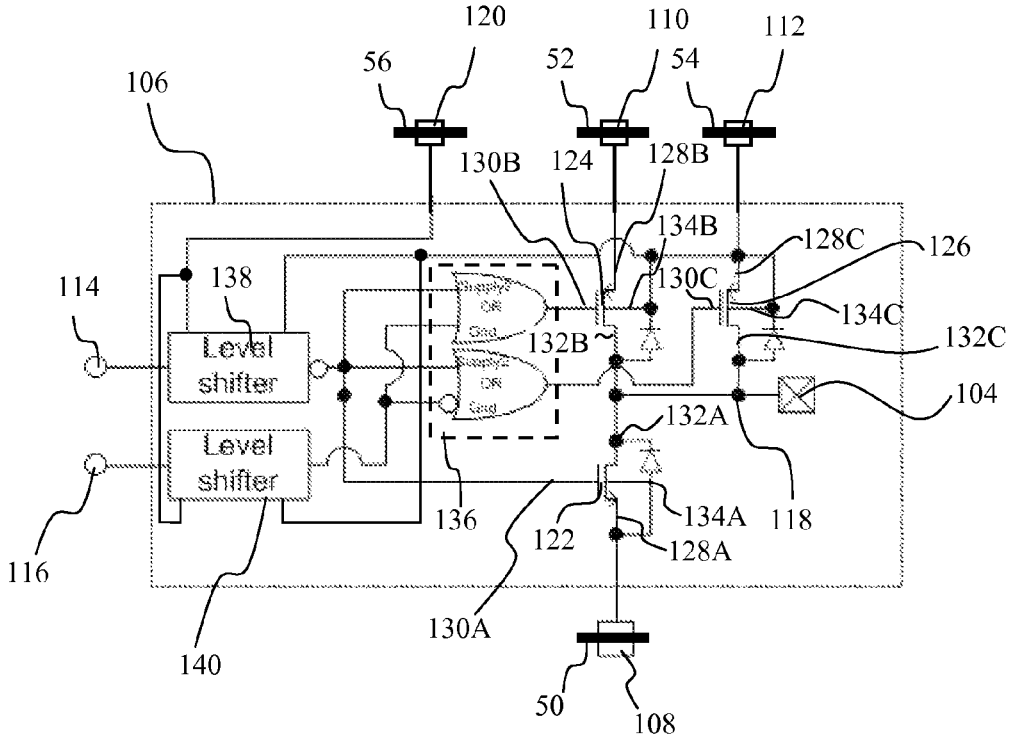
FIG. 3 schematically illustrates an exemplary output cell.

FIG. 3 illustrates an exemplary output cell according to some embodiments, e.g. a first and/or a second output cell which for example may be implemented in one or more of the communication cells of the integrated circuit in FIG. 2. The output cell 106 has a ground pin 108 connected to a ground rail 50 of the integrated circuit, a first power supply pin 110 connected to a first power rail 52 of the integrated circuit adapted to carry a first voltage $V_1$, a second power supply pin 112 connected to a second power rail 54 of the integrated circuit adapted to carry a second voltage $V_2$, a data pin 114, at least one voltage select pin 116 and an output pin 118 wired to the first output pad 104. The output cell 106 further comprises a core power supply pin 120 connected to the core power rail 56. The first output pad 104 may be embedded in the output cell 106 as illustrated or be arranged outside the output cell in the integrated circuit.

The output cell 106, i.e. the first output cell, is adapted to operate according to a first mode wherein the voltage on the output pin 118 has a first amplitude $V_1$*, and according to a second mode wherein the voltage on the first output pin has a second amplitude $V_2$*, larger than the first amplitude depending on a control signal applied to the at least one voltage select pin 116. The output cell 106 comprises a first transistor 122, a second transistor 124 and a third transistor 126 having respective first terminals 128A, 128B, 128C, second terminals 130A, 130B, 130C, third terminals 132A, 132B, 132C, and fourth terminals 134A, 134B, 134C. A logical circuit 136 is arranged between the at least one voltage select pin 116 and the second terminals 130B and 130C to selectively activate the second transistor and the third transistor depending on desired mode of operation. The output cell comprises a first level shifter 138 coupled between the data pin 114 and the second terminals 130B and 130C to adjust data signal level. Further, a second level shifter 140 is coupled between the at least one voltage select pin 116 and the second terminals 130B and 130C to adjust voltage select signal level. The level shifters 138, 140 are connected to the second power power supply pin 112 and the core power supply pin 120. The at least one voltage select pin 116 may comprise a first voltage select pin and a second voltage select pin in order to select between more than two different operating modes of the output cell. Each transistor has an intrinsic parasitic diode between the third terminal and the fourth terminal which is also illustrated in FIG. 3. The coupling of fourth terminals eliminate or reduce parasitic currents between fourth and third terminals of the drive transistors.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2 hearing device
4 audio input interface
6 analog-digital (AD) converter unit
8 signal processing unit
10 user interface
12 memory unit
14 radio unit
16 loudspeaker/receiver
18 core
20 communication cell (Master interface)
22 clock management unit
24 audio input/output
26 H-bridge
28 communication cell (Wireless controller)
30 communication cell (IIC Master)
32 communication cell (IIS interface)
34 communication cell (SPI Master)
36 communication cell (Com interface)
38 communication cell (IIC slave)
50 ground rail
52 first power rail
54 second power rail
56 core power rail
104 first output pad
106 output cell
108 ground pin
110 first power supply pin
112 second power supply pin
114 data pin
116 voltage select pin(s)
118 output pin or output node
120 core power supply pin
122 first transistor
124 second transistor
126 third transistor
128A, 128B, 128C first terminal
130A, 130B, 130C second terminal
132A, 132B, 132C third terminal
134A, 134B, 134C fourth terminal
136 logical circuit
138 first level shifter
140 second level shifter

The invention claimed is:

1. An integrated circuit for a hearing device, comprising:
a ground rail;
a first power rail configured to carry a first voltage (V1);
a second power rail configured to carry a second voltage (V2);
a number of pads for connecting the integrated circuit to other components, the number of pads including at least one output pad, the at least one output pad having a first output pad;
at least one output cell including a first output cell having
a ground pin connected to the ground rail,
a first power supply pin connected to the first power rail,
a second power supply pin connected to the second power rail,
a data pin,
at least one voltage select pin, and
an output pin wired to the first output pad;
wherein the first output cell is configured to operate according to a first mode wherein the output pin has a first voltage amplitude, and according to a second mode wherein the output pin has a second voltage amplitude larger than the first voltage amplitude depending on a control signal applied to the at least one voltage select pin;
wherein the first output cell comprises a first transistor having a first terminal, a second terminal, a third terminal, and a fourth terminal, and wherein the first terminal of the first transistor is wired to the ground pin, the second terminal of the first transistor is connected to the data pin, the third terminal of the first transistor is wired to the output pin, and the fourth terminal of the first transistor is wired to the first terminal of the first transistor.

2. The integrated circuit according to claim 1, wherein the first output cell comprises at least three transistors including the first transistor, a second transistor, and a third transistor, each of the second and third transistors having a first terminal, a second terminal, a third terminal and a fourth terminal.

3. The integrated circuit according to claim 2, wherein the fourth terminal of the second transistor and the fourth terminal of the third transistor are wired to one of the first and second power supply pins having a larger voltage.

4. The integrated circuit according to claim 2, wherein the fourth terminal of the second transistor and the fourth terminal of the third transistor are wired to a common terminal.

5. The integrated circuit according to claim 4, wherein the first terminal of the third transistor is wired to the second power supply pin, and wherein the first terminal of the third transistor is the common terminal.

6. The integrated circuit according to claim 2, wherein the first terminal of the second transistor is wired to the first power supply pin.

7. The integrated circuit according to claim 1, wherein the second terminal of the first transistor is connected to the data pin via a level shifter.

8. The integrated circuit according to claim 2, wherein the third terminal of the second transistor and the third transistor are wired to the output pin.

9. The integrated circuit according to claim 2, further comprising a third power rail configured to carry a third voltage (V3), wherein the first output cell comprises a fourth transistor connected between the output pin and a third power supply pin, the third power supply pin being connected to the third power rail.

10. The integrated circuit according to claim 9, wherein the fourth transistor has a first terminal, a second terminal, a third terminal and a fourth terminal, wherein the fourth terminal is wired to a common terminal, and wherein the first output cell is configured to operate according to a third mode wherein the output pin has a third voltage amplitude depending on a control signal applied to the at least one voltage select pin.

11. The integrated circuit according to claim 10, wherein the first terminal of the fourth transistor is wired to the third power supply pin, and the third terminal of the fourth transistor is wired to the output pin.

12. An integrated circuit for a hearing device, comprising:

a ground rail;

a first power rail configured to carry a first voltage (V1);

a second power rail configured to carry a second voltage (V2);

a number of pads for connecting the integrated circuit to other components, the number of pads including at least one output pad, the at least one output pad having a first output pad;

at least one output cell including a first output cell having a ground pin connected to the ground rail, a first power supply pin connected to the first power rail, a second power supply in connected to the second power rail, a data pin, at least one voltage select pin, and an output pin wired to the first output pad;

wherein the first output cell is configured to operate according to a first mode wherein the output pin has a first voltage amplitude, and according to a second mode wherein the output pin has a second voltage amplitude larger than the first voltage amplitude depending on a control signal applied to the at least one voltage select pin;

wherein the first output cell comprises at least three transistors including a first transistor, a second transistor, and a third transistor, each of the transistors having a first terminal, a second terminal, a third terminal and a fourth terminal; and wherein the first output cell comprises a logical circuit having an input connected to the at least one voltage select pin and the data pin, and an output connected to the second terminal of the second transistor and the second terminal of the third transistor, for selectively activating the second transistor or third transistor, respectively, to select one of the modes.

13. The integrated circuit according to claim 1, further comprising a core connected to the first output cell, wherein the core is configured to perform signal processing for a hearing device.

14. A hearing device comprising the integrated circuit of claim 1.

* * * * *